US005827990A

United States Patent [19]

Fujita

[11] Patent Number: 5,827,990

[45] Date of Patent: Oct. 27, 1998

[54] KARAOKE APPARATUS APPLYING EFFECT SOUND TO BACKGROUND VIDEO

[75] Inventor: Hiroyuki Fujita, Hamamatsu, Japan

[73] Assignee: Yamaha Corporation, Hamamatsu, Japan

[21] Appl. No.: 821,597

[22] Filed: Mar. 20, 1997

[30] Foreign Application Priority Data

Mar. 27, 1996 [JP] Japan ..... 8-072498

[51] Int. Cl.[6] ..... G10H 1/36; G10H 7/00

[52] U.S. Cl. ..... 84/610; 434/307 A

[58] Field of Search ..... 434/307 A; 84/609, 84/610, 634, 636

[56] References Cited

U.S. PATENT DOCUMENTS 4,966,051 10/1990 Tajima .
5,410,097 4/1995 Kato et al. ..... 84/610
5,542,000 7/1996 Semba .
5,569,869 10/1996 Sone ..... 84/609
5,609,486 3/1997 Miyashita et al. ..... 434/307 A
5,611,693 3/1997 Chaya et al. .

*Primary Examiner*—William M. Shoop, Jr.
*Assistant Examiner*—Jeffrey W. Donels
*Attorney, Agent, or Firm*—Pillsbury Madison & Sutro LLP

[57] ABSTRACT

A karaoke apparatus provides audio and video to support live karaoke play based on karaoke data. In the karaoke apparatus, a first sound device operates according to the karaoke data for generating a musical sound as a part of the audio so as to accompany the live karaoke play. A display device operates according to the karaoke data for displaying a background scene as a part of the video in matching with the musical sound so as to enhance the live karaoke play. A second sound device operates according to the karaoke data for generating an effect sound as another part of the audio so as to create an acoustic impression specific to the displayed background scene to thereby further enhance the live karaoke play.

17 Claims, 6 Drawing Sheets

| | | | |
|---|---|---|---|
| HEADER | VIDEO DATA | MUSICAL SOUND TRACK | VOICE DATA 1 |
| | | WORD TRACK | VOICE DATA 2 |
| | | VOICE TRACK | ⋮ VOICE DATA n |
| | | EFFECT CONTROL TRACK | ⋮ |

KARAOKE APPARATUS APPLYING EFFECT SOUND TO BACKGROUND VIDEO

BACKGROUND OF THE INVENTION

1. Field of the Invention

The present invention relates to a karaoke apparatus for displaying a background video along with karaoke playing.

2. Description of Related Art

Karaoke apparatuses display a background video for the karaoke music piece being played. Generally, the background video requires a huge volume of video data. The karaoke apparatus stores pictures of the background video of various genres, and selects a suitable picture of a desired genre to which a requested music piece belongs, in terms of an attribute such as a season that the requested music piece presents. Stated otherwise, a limited number of common pictures are selectively used for a requested music piece to be played, rather than storing unique pictures of the background video for all music pieces registered in the karaoke apparatus. For example, in a karaoke apparatus having a tone generator, genre information is written in a header of the karaoke data which has a MIDI data format or the like. The genre information is used as a search key for searching an LD (Laser Disc) or a CD-ROM to retrieve therefrom a background picture suited to the karaoke music piece to be played. The retrieved background picture is visually reproduced to enhance or enrich karaoke play in matching with the music piece.

The background video that supports or accompanies the karaoke playing has diverse properties such as location, atmosphere, character and so on. In the background video for one piece of karaoke music, scenes change one after another as the karaoke music piece progresses. The conventional karaoke apparatus, however, does not reproduce a picture unique to a specific piece of karaoke music during the course of the progression of the music piece. The conventional karaoke apparatus only selects a common background picture that is generally suited to the genre to which the requested particular music piece belongs, and reproduces the selected picture concurrently with the playing of the karaoke music piece. Such a constitution only adds a visual effect to the karaoke play, but cannot enhance or enrich the karaoke play much more.

SUMMARY OF THE INVENTION

It is therefore an object of the present invention to provide a karaoke apparatus that provides effect sounds matching a background video of the karaoke music piece being played, thereby allowing a karaoke player to sing with feeling of presence for a more enjoyable performance.

According to the invention, a karaoke apparatus provides an audio and a video to support a karaoke play based on karaoke data. The karaoke apparatus comprises a first sound device that operates according to the karaoke data for generating a musical sound as a part of the audio so as to accompany with the karaoke play, a display device that operates according to the karaoke data for displaying a background scene as a part of the video in matching with the musical sound so as to enhance the karaoke play, and a second sound device that operates according to the karaoke data for generating an effect sound as another part of the audio so as to create an acoustic impression specific to the displayed background scene to thereby further enhance the karaoke play.

The karaoke apparatus further comprises a sound control device that operates according to the karaoke data for controlling the effect sound so as to create a sound field matching the displayed background scene. The sound control device creates an open sound field when an outdoor background scene is displayed, and creates a closed sound field when an indoor background scene is displayed. The sound control device further controls the musical sound so as to impart thereto an acoustic effect enhancing the karaoke play.

In a preferred form, the display device sequentially displays different background scenes during the course of the karaoke play, and the second sound device cooperates with the display device for sequentially generating different effect sounds corresponding to the displayed different background scenes. The sound control device controls each of the different effect sounds so as to create a sound field matching the corresponding background scene.

In another preferred form, the first sound device comprises a tone generator that synthesizes the musical sound, while the second sound device comprises a decoder that reproduces the effect sound designated by the karaoke data and selected from a plurality of pre-stored effect sounds.

The above and other objects, features and advantages of the present invention will become more apparent from the accompanying drawings, in which like reference numerals are used to identify the same or similar parts in several views.

DETAILED DESCRIPTION OF PREFERRED EMBODIMENTS

Figures 1, 3:
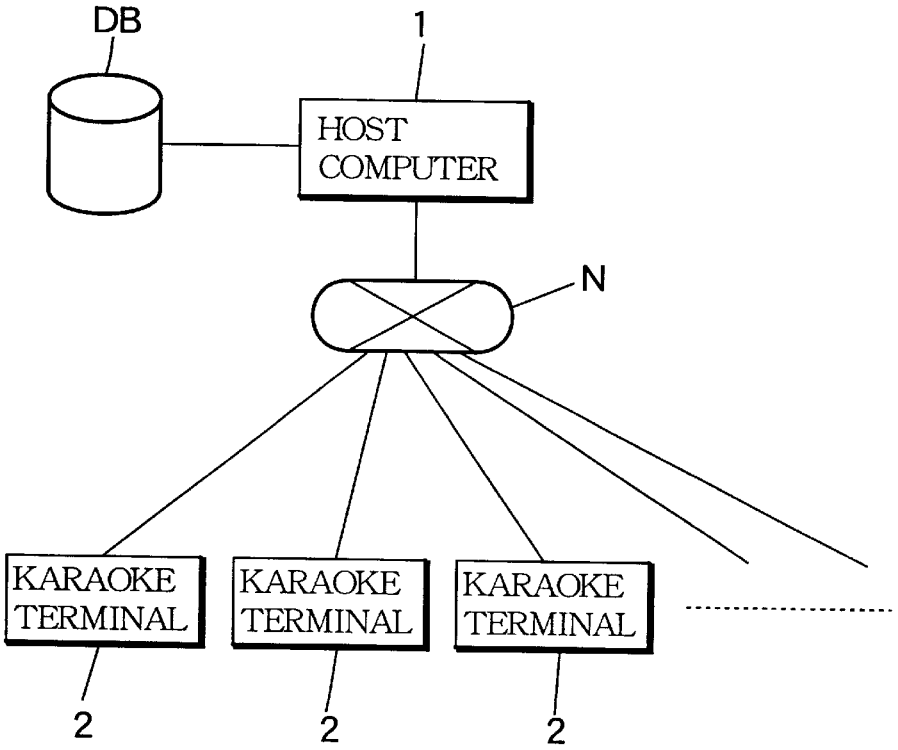
FIG. 1 is a block diagram illustrating an overall constitution of a karaoke system practiced as one preferred embodiment of the present invention.
FIG. 3 is a diagram illustrating a format of karaoke data used in the embodiment of FIG. 1.

This invention will be described in further detail by way of example with reference to the accompanying drawings. FIG. 1 is a block diagram illustrating a karaoke system according to as one preferred embodiment of the present invention. In the figure, reference numeral 1 denotes a host computer or server computer installed at a karaoke center station. The host computer 1 has a database DB that stores a vast volume of karaoke data. The host computer 1 is connected to a plurality of karaoke terminals or karaoke apparatuses 2 installed at local karaoke amusement facilities via a communication line N which may be a switched line or an ISDN (Integrated Services Digital Network). The host computer 1 periodically delivers karaoke data of new music pieces to these karaoke terminals 2.

Figure 2:
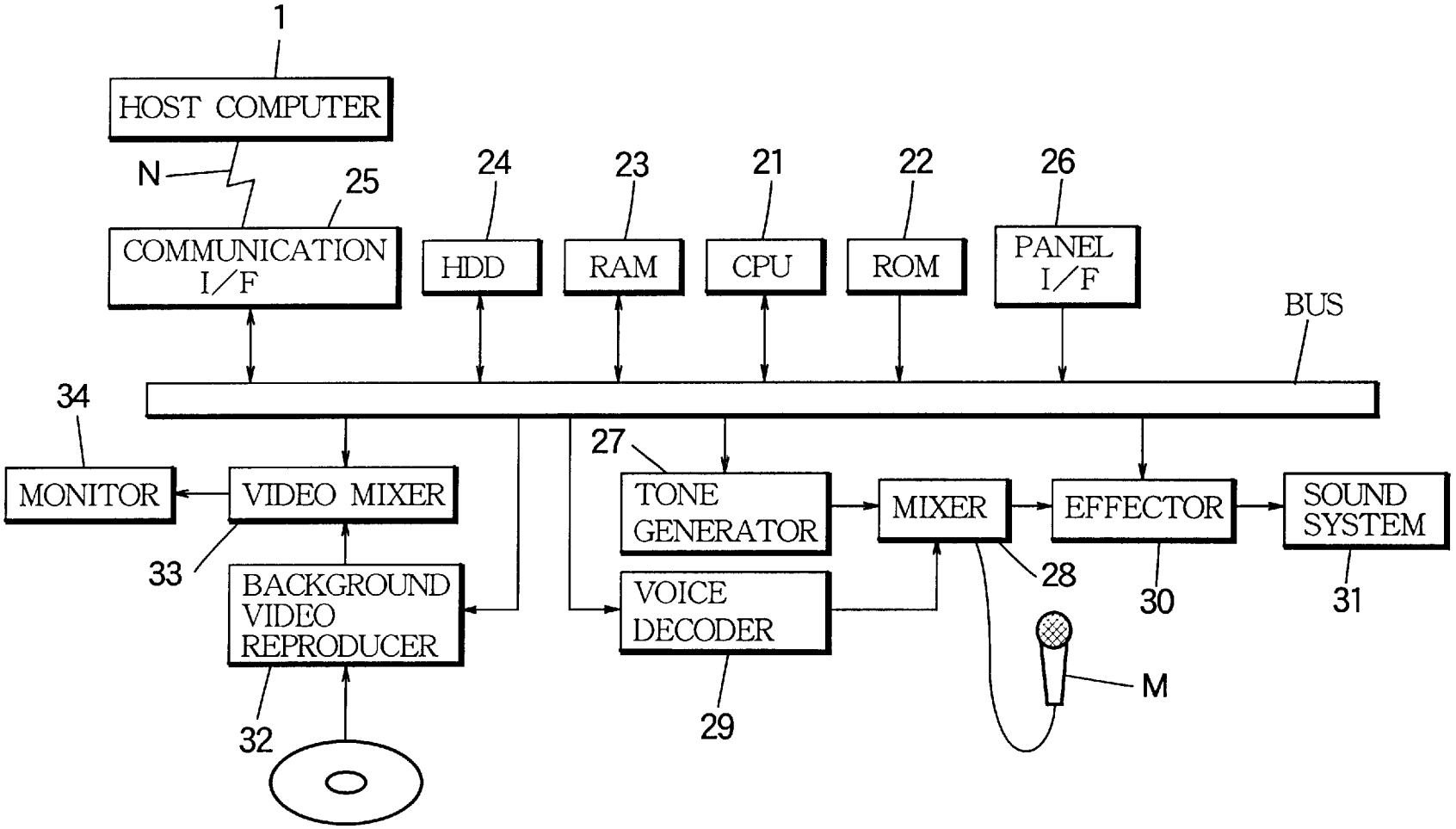
FIG. 2 is a block diagram illustrating a constitution of a karaoke terminal involved in the embodiment of FIG. 1.

FIG. 2 shows a block diagram illustrating the constitution of the karaoke terminal 2. In the figure, reference numeral 21 denotes a CPU (Central Processing Unit) which controls all device blocks of the karaoke terminal interconnected via a bus BUS. Reference numeral 22 denotes a ROM (Read Only Memory) for storing a control program executed by the CPU 21 and font data used for displaying lyrics included in the karaoke data. Reference numeral 23 denotes a RAM (Random Access Memory) which serves as a work area for the CPU 21. Reference numeral 24 denotes a hard disk drive (HDD) for storing the karaoke data distributed from the host computer 1. Each karaoke terminal stores the karaoke data distributed from the host computer 1 on the hard disk, and then reads out selected ones of the stored karaoke data for karaoke playing.

Reference numeral 25 denotes a communication interface (I/F) for receiving the karaoke data transmitted from the host computer 1, and transfers the received karaoke data to the hard disk drive 24 by means of DMA (Direct Memory Access). Reference numeral 26 denotes a panel interface (I/F) for detecting key input operation such as inputting a music piece number, instructing start or stop of karaoke playing, and setting volume or tempo of a music piece. Such a key input operation is made by an operation panel of the karaoke apparatus or a remote commander (not shown). The panel interface 26 supplies the detection result of the key input operation to the CPU 21.

Reference numeral 27 denotes a tone generator which is a first sound device for synthesizing a musical sound signal according to musical sound control data included in the karaoke data supplied from the CPU 21, and outputs the synthesized music sound signal to a mixer 28. Reference numeral 29 denotes a voice decoder which is a second sound device for reproducing voice data according to ADPCM (Adaptive Differential Pulse Code Modulation) data. The voice data includes a background chorus sound specified by the karaoke data and an effect sound specified by video data contained in the karaoke data. The voice decoder 29 outputs the generated voice data to the mixer 28. The mixer 28 mixes the musical sound supplied from the tone generator 27, the background chorus sound or the effect sound supplied from the voice decoder 29, and a live singing sound uttered by a karaoke player inputted from a microphone M.

Reference numeral 30 denotes an acoustic effector which is a sound control device for controlling the output of the mixer 28 to create acoustic effects such as echo, reverberation and delay based on sound control data included in the musical sound data or the video data supplied from the CPU 21. Reference numeral 31 denotes a sound system which eliminates a noise component and other undesired components from the output of the effector 30, and emits the resultant sounds from a speaker (not shown).

Reference numeral 32 denotes a background video reproducer which is a part of a display device operative according to the video data for displaying karaoke background video stored in a video storage medium such as a motion picture CD. Reference numeral 33 denotes a video mixer which superimposes the font data of lyric words read out from the ROM 22 on the background video, and outputs the resultant synthesized image. Reference numeral 34 denotes a monitor for displaying the synthesized image of the background video and the lyric words corresponding to the output of the video mixer 33.

The following describes details of the karaoke data. As shown in FIG. 3, the karaoke data of one karaoke music piece are composed of a header, a musical sound track, a word track, a voice track, an effect control track, and a voice data area. The header contains various items of index data associated with the karaoke music piece. To be specific, the index data includes song code, title, genre, playing duration and so on.

The music sound track records sequence data for controlling the musical sound synthesis effected by the tone generator 27. The sequence data are composed of note event data for controlling sounding and muting of notes, and duration data for controlling timing of note-on and note-off. The word track records character code information corresponding to the karaoke lyrics to be displayed on the monitor 34 in synchronization with the progression of the karaoke music piece. The voice track records address information for reading out the ADPCM data of the background chorus sound from the voice data area in synchronization with the progression of the music piece. The effect control track records control data for controlling the acoustic effects such as echo and reverberation to be applied to the musical sound and so on.

Figure 4:
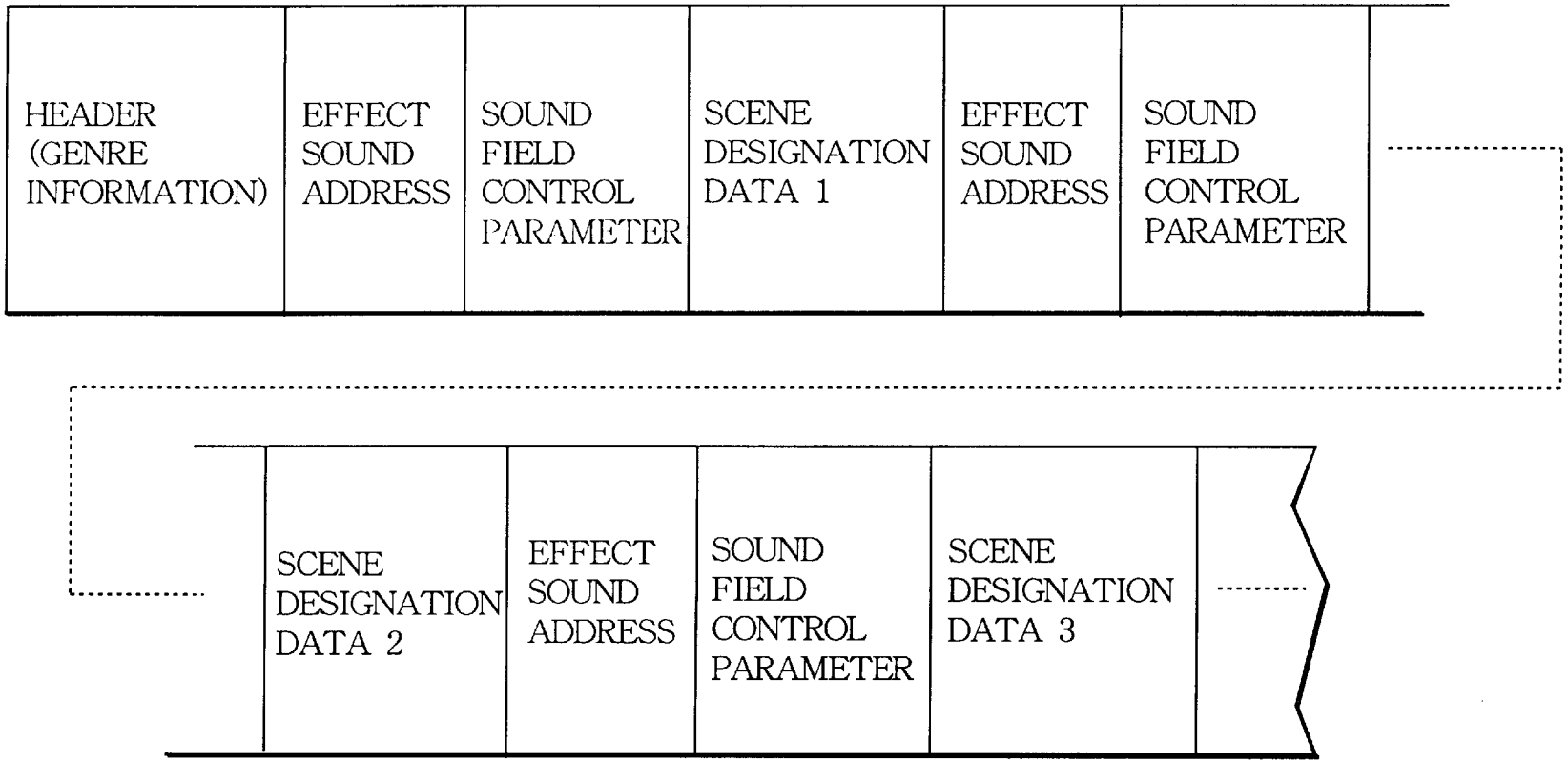
FIG. 4 is a diagram illustrating details of video data contained in the karaoke data used in the embodiment of FIG. 1.

The following describes details of the video data contained in the karaoke data. As shown in FIG. 4, the video data of one karaoke music piece is composed of a sequence of scene designation data each allotted a predetermined time slot and arranged after the header including the genre information. Each scene designation data is preceded by an effect sound address for specifying an effect sound matching a background scene specified by the scene designation data and a sound field control parameter for controlling a sound field applied to the effect sound.

Figure 5:
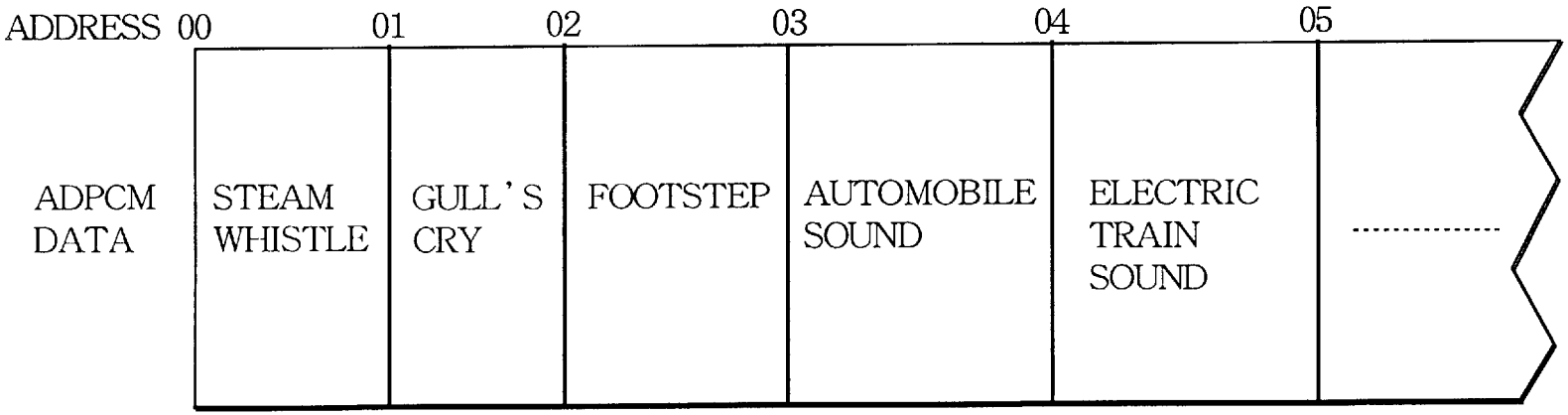
FIG. 5 is a diagram illustrating contents of an effect sound data file used in the embodiment of FIG. 1.

It should be noted that voice data for generating the effect sound are constituted, as shown in FIG. 5, in a data file containing ADPCM data of various effect sounds, for example, a steam whistle, a gull's cry, and a footstep. Each item of the effect sounds is referenced by the effect sound address contained in the video data. This data file is stored in the hard disk drive 24, and is delivered to each karaoke terminal 2 from the host computer 1 of the karaoke center station via the communication line N in manner similar to the karaoke data.

The sound field control parameter is utilized to control a delay time of a reflective sound generated by the effector 30 by way of example. For instance, if an open background scene such as a port or a coast where the location is open all around is displayed as BGV, the sound field parameter is set for increasing or making infinite the delay time in correspondence with the location of the background scene. In this case, an open sound field is created such that the effect sound is heard as if traveling through an open space. Conversely, if a closed location such as a small room is displayed as the background scene, the sound field control parameter is set for decreasing the delay time. In this case, a closed sound field is created such that the effect sound is heard as if confined.

The following describes the operation of the karaoke apparatus having the above-mentioned novel constitution. First, when a user inputs the song number of a desired karaoke music piece to be played by means of the remote commander, the inputted song number is fed to the CPU 21 via the panel interface 26. The CPU 21 starts searching the hard disk drive 24 for the karaoke data corresponding to the specified song number. Upon retrieval of the searched karaoke data from the hard disk drive 24, the CPU 21 checks the header of the retrieved karaoke data to read genre information. From the read genre information, the CPU 21 obtains an address of BGV via a predetermined conversion table, and sends the obtained address to the background video reproducer 32. Based on this address, the background video reproducer 32 searches the video recording medium for the BGV corresponding to the genre of the specified karaoke music piece, and prepares for reproduction of the retrieved BGV.

Thus, when the karaoke data containing the various tracks and the video data is retrieved, both the various tracks and the video data are processed concurrently. As for the audio, the musical sound track, the word track, the voice track, and the effect control track are processed in synchronization with each other in a time division manner. This process supplies the musical control data read from the musical sound track to the tone generator 27, supplies the character data corresponding to the lyric words read from the word track to the video mixer 33 from the ROM 22, supplies the ADPCM data read from the voice data area specified in the voice track to the voice decoder 29, and supplies the control data read from the effect control track to the effector 30.

As for the video data, the scene designation data, the effect sound address and the sound field control parameter are read out concurrently with the above-mentioned process of the various tracks. By such an operation, the ADPCM data of the effect sound specified by the effect sound address is transferred to the voice decoder 29. At the same time, the sound control parameter is fed to the effector 30. Further, a particular scene of the BGV designated by the scene designation data is transferred to the video mixer 33. It should be noted that the timing at which each effect sound is generated is determined by a generation instruction included in the video data.

Thus, the karaoke music sound corresponding to the musical control data is synthesized by the tone generator 27, while the background chorus sound and the effect sound supporting the background video are reproduced by the voice decoder 29. Further, the musical sound, the chorus sound and the effect sound are mixed by the mixer 28 with a live singing voice inputted from the microphone M. The resultant sound is applied with a sound field or acoustic effect such as echo and reverberation by the effector 30. Particularly, the sound field control is performed on the effect sound in matching with the scene of the BGV. The final composite sound is emitted from the speaker via the sound system 31. Concurrently with this karaoke playing, the characters of the lyric words are superimposed on the background video by the video mixer 33. The resultant synthesized image is displayed on the monitor 34.

According to the above-mentioned embodiment, the effect sound corresponding to the scene of the background video displayed along with the karaoke playing can be added to the karaoke musical sound. Further, the sound field corresponding to the scene of the background video can be formed. This novel constitution allows the karaoke apparatus to add effect sounds such as a steam whistle and a gull's cry if the background video of a port, for example, is being displayed. Further, the inventive karaoke apparatus can form a sound field in which the effect sound is heard as if traveling through the space of the scene of the BGV, thereby providing the feeling of presence to the karaoke player for much more fun and enjoyment.

In the above-mentioned embodiment, the karaoke music sound, the effect sound for the background video and the singing voice are all mixed in the mixer 28, and the sound field control corresponding to the background video is performed on the mixed sounds by the effector 30. Instead of performing the sound field control on all sounds, the sound field control may be performed separately on the effect sound and the singing voice. For example, as shown in FIG. 5, to perform the sound field control on only the effect sound corresponding to the background video, the output of the voice decoder 29 may be divided into a background chorus sound V1 and an effect sound V2 corresponding to the background video. To implement this constitution, an additional effector 30' is provided for performing the sound field control on the effect sound V2 alone before the same is fed to the mixer 28. A main effector 30 applies acoustic effects specified by the effect control track of the karaoke data to the output from the mixer 28.

Figure 6:
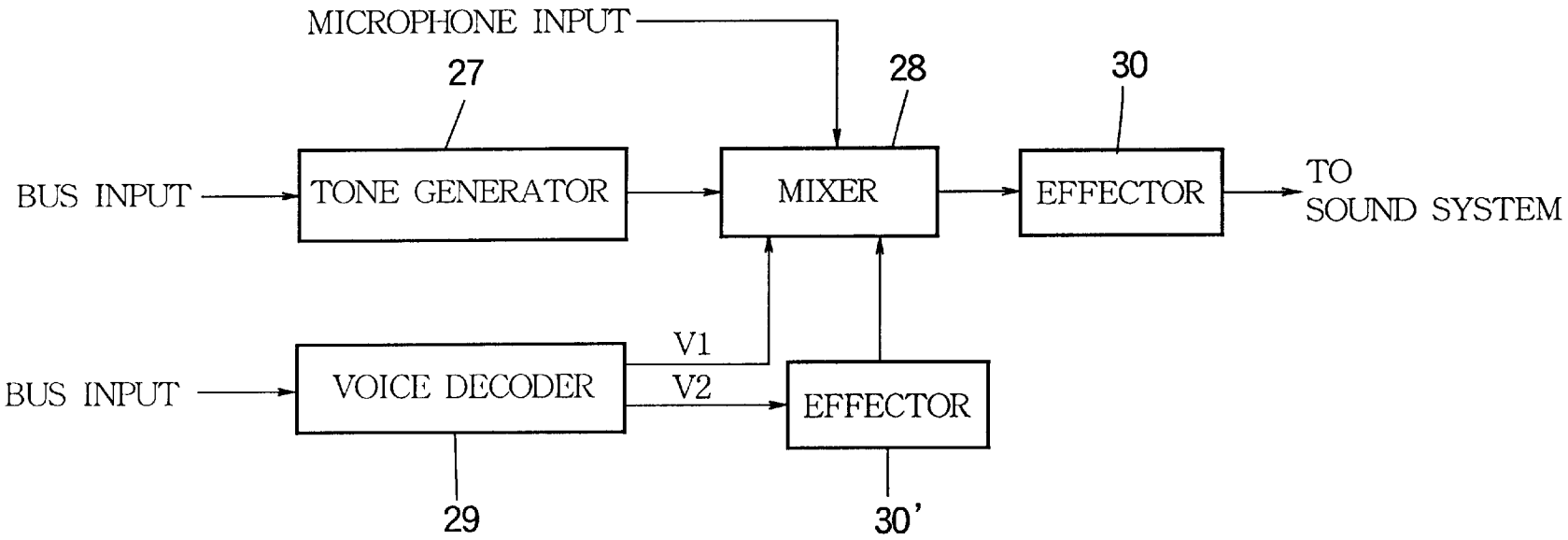
FIG. 6 is a block diagram illustrating another embodiment of the present invention.

According to the embodiment of FIG. 6, the karaoke apparatus provides an audio and a video to support the karaoke play based on the karaoke data. The karaoke apparatus comprises a first sound device in the form of the tone generator 27 that operates according to the karaoke data for generating the karaoke musical sound as a part of the audio so as to accompany the karaoke play, a display device (not shown) that operates according to the karaoke data for displaying a background scene as a part of the video in matching with the musical sound so as to enhance the karaoke play, and a second sound device in the form of the decoder 29 that operates according to the karaoke data for generating the effect sound V2 as another part of the audio so as to create an acoustic impression specific to the displayed background scene to thereby further enhance the karaoke play. The karaoke apparatus further comprises a sound control device in the form of the effector 30' that operates according to the karaoke data for controlling the effect sound V2 so as to create the sound field matching the displayed background scene. The effector 30' creates an open sound field when an outdoor background scene is displayed, and creates a closed sound field when an indoor background scene is displayed. The sound control device in the form of the other effector 30 further controls the musical sound so as to impart thereto an acoustic effect enhancing the karaoke play.

In a preferred form, the display device sequentially displays different background scenes during the course of the karaoke play, and the decoder 29 cooperates with the display device for sequentially generating different effect sounds corresponding to the displayed different background scenes. The effector 30' controls each of the different effect sounds so as to create a sound field matching the corresponding scene. In another preferred form, the first sound device comprises the tone generator 27 that synthesizes the musical sound, while the second sound device comprises the decoder 29 that reproduces the effect sound designated by the karaoke data and selected from a plurality of pre-stored effect sounds.

Figure 7:
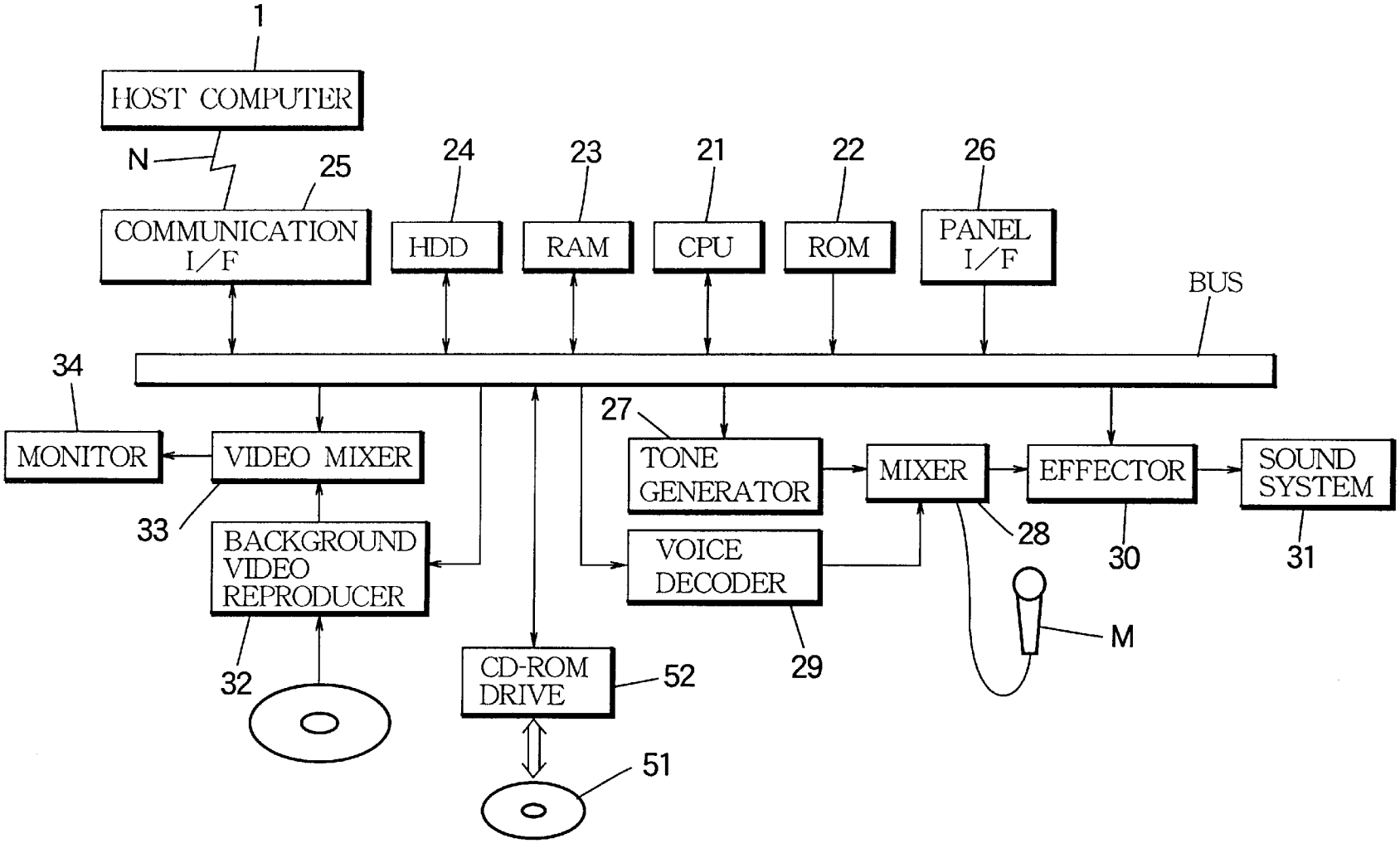
FIG. 7 is a block diagram illustrating still another embodiment of the present invention.

FIG. 7 shows an additional embodiment of the inventive karaoke apparatus. This embodiment has basically the same construction as the previous embodiment shown in FIG. 1. The same components are denoted by the same references as those of the previous embodiment to facilitate better understanding of the additional embodiment. The storage such as ROM 22, RAM 23 and hard disk drive (HDD) 24 can store various data such as karaoke data and various programs including a system control program or basic program, a tone generating program and other application programs. Normally, the ROM 22 provisionally stores these programs. However, if not, any program may be loaded into the karaoke apparatus. The loaded program is transferred to the RAM 23 to enable the CPU 21 to operate the inventive system of the karaoke apparatus. By such a manner, new or version-upgrade programs can be readily installed in the system. For this purpose, a machine-readable media such as a CD-ROM (Compact Disc Read Only Memory) 51 is utilized to install the program. The CD-ROM 51 is set into a CD-ROM drive 52 to read out and download the program from the CD-ROM 51 into the HDD 24 through the bus. The machine-readable media may be composed of a magnetic disk or an optical disk other than the CD-ROM 51.

A communication interface 25 is connected to an external server computer or host computer 1 through a communication network N such as LAN (Local Area Network), public telephone network and INTERNET. If the internal storage does not contain the needed data or program, the communication interface 25 is activated to receive the data or program from the server computer 1. The CPU 21 transmits a request to the server computer 1 through the interface 25 and the network N. In response to the request, the server computer 1 transmits the requested data or program to the karaoke apparatus. The transmitted data or program is stored in the storage to thereby complete the downloading.

The inventive karaoke apparatus can be implemented by a personal computer which is installed with the needed data and programs. In such a case, the data and programs are provided to the user by means of the machine-readable media such as the CD-ROM 51 or a floppy disk. The machine readable media contains instructions for causing the personal computer to perform the inventive karaoke playing method as described in conjunction with the previous embodiments. Namely, the machine readable media contains instructions to cause the karaoke terminal machine to perform a method of providing an audio and a video to support a karaoke play based on karaoke data. The method comprises the steps of generating a musical sound according to the karaoke data as a part of the audio so as to accompany with the karaoke play, displaying a background scene as a part of the video according to the karaoke data in matching with the musical sound so as to enhance the karaoke play, and generating an effect sound as another part of the audio according to the karaoke data so as to produce an acoustic impression specific to the displayed background scene to thereby further enhance the karaoke play. The method further comprises the step of controlling the effect sound according to the karaoke data so as to create a sound field matching the displayed background scene. Preferably, the step of displaying comprises sequentially displaying different background scenes during the course of the karaoke play, and the step of generating an effect sound comprises sequentially generating different effect sounds corresponding to the displayed different background scenes.

In the above-mentioned embodiments, the effect sound corresponding to the background video is presented, and the sound field control is also performed. It will be apparent that only one of the effect sound and the sound field control may be enough for providing the feeling of presence to the karaoke player. This variation requires less data than those required by the above-mentioned embodiments, and is simpler in constitution.

Instead of using the above-mentioned sound field control parameter for controlling the reflective sound delay time, other parameters for controlling an intensity and a direction of the reflective sound may be used.

Instead of the data files for the BGV and the effect sounds having the format of the above-mentioned embodiments, data files of any other formats may be used as long as the capabilities according to the present invention can be realized.

In the above-mentioned embodiments, the present invention is applied to the karaoke system built on a communication network. It will be apparent that the present invention is also applicable to any other karaoke systems that can display the background video concurrently with the karaoke playing.

As described above and according to the present invention, the effect sound and the sound field matching the background video are formed for the karaoke music piece being played, thereby providing the feeling of presence to a karaoke player for more singing enjoyment. While the preferred embodiments and the variations of the present invention have been described using specific terms, such description is for illustrative purposes only, and it is to be understood that changes and variations may be made without departing from the spirit or scope of the appended claims.

What is claimed is:

1. A karaoke apparatus for providing audio and video to support a karaoke play based on karaoke data, said karaoke apparatus comprising:

a first sound device that operates according to the karaoke data for generating a musical sound as a part of the audio so as to accompany the karaoke play;

a display device that operates according to the karaoke data for displaying a background scene as a part of the video, the displayed background scene matching with the musical sound; and a second sound device that operates according to the karaoke data for generating an effect sound as another part of the audio, the effect sound being associated with the displayed background scene in order to produce an acoustic impression specific to the displayed background scene.

2. The karaoke apparatus according to claim 1, further comprising a sound control device that operates according to the karaoke data for controlling the effect sound so as to create a sound field matching the displayed background scene.

3. The karaoke apparatus according to claim 2, wherein the sound control device creates an open sound field when an outdoor background scene is displayed, and creates a closed sound field when an indoor background scene is displayed.

4. The karaoke apparatus according to claim 2, wherein the sound control device also controls the musical sound so as to impart thereto an acoustic effect.

5. A karaoke apparatus for providing audio and video to support a karaoke play based on karaoke data, said karaoke apparatus comprising:

a first sound device that operates according to the karaoke data for generating a musical sound as a part of the audio so as to accompany the karaoke play;

a display device that operates according to the karaoke data for displaying a background scene as a part of the video in matching with the musical sound; and a second sound device that operates according to the karaoke data for generating an effect sound as another part of the audio so as to produce an acoustic impression specific to the displayed background scene, wherein the display device sequentially displays different background scenes during the course of the karaoke play, and the second sound device cooperates with the display device for sequentially generating different effect sounds corresponding to the displayed different background scenes.

6. The karaoke apparatus according to claim 5, further comprising a sound control device that controls each of the different effect sounds so as to create a sound field matching the corresponding displayed background scene.

7. A karaoke apparatus for providing audio and video to support a karaoke play based on karaoke data, said karaoke apparatus comprising:

a first sound device that operates according to the karaoke data for generating a musical sound as a part of the audio so as to accompany the karaoke play:

a display device that operates according to the karaoke data for displaying a background scene as a part of the video in matching with the musical sound; and a second sound device that operates according to the karaoke data for generating an effect sound as another part of the audio so as to produce an acoustic impression specific to the displayed background scene, wherein the first sound device comprises a tone generator that synthesizes the musical sound, and the second sound device comprises a decoder that reproduces the effect sound designated by the karaoke data, the designated effect sound being selected from a plurality of pre-stored effect sounds.

8. A karaoke apparatus for providing audio and video to support a singing play based on karaoke data, said karaoke apparatus comprising:

first sound means operative according to the karaoke data for generating an instrumental accompaniment sound as a part of the audio so as to accompany the singing play;

display means operative according to the karaoke data for displaying a background scene as a part of the video, the displayed background scene matching with the instrumental accompaniment sound; and second sound means operative according to the karaoke data for generating an effect sound as another part of the audio, the effect sound being associated with the displayed background scene in order to produce an acoustic impression specific to the displayed background scene.

9. The karaoke apparatus according to claim 8, further comprising sound control means operative according to the karaoke data for controlling the effect sound so as to create a sound field matching the displayed background scene.

10. A karaoke apparatus for providing audio and video to support a singing play based on karaoke data, comprising:

first sound means operative according to the karaoke data for generating an instrumental accompaniment sound as a part of the audio so as to accompany the singing play;

display means operative according to the karaoke data for displaying a background scene as a part of the video in matching with the instrumental accompaniment sound; and second sound means operative according to the karaoke data for generating an effect sound as another part of the audio so as to produce an acoustic impression specific to the displayed background scene, wherein the display means sequentially displays different background scenes during the course of the singing play, and the second sound means cooperates with the display means for sequentially generating different effect sounds corresponding to the displayed different background scenes.

11. A method of providing audio and video to support a karaoke play based on karaoke data, said method comprising the steps of:

generating a musical sound as a part of the audio so as to accompany the karaoke play, the musical sound being generated based on the karaoke data;

displaying a background scene as a part of the video, the displayed background scene matching with the musical sound and being displayed based on the karaoke data; and generating an effect sound as another part of the audio, the effect sound being associated with the displayed background scene in order to produce an acoustic impression specific to the displayed background scene and being generated based on the karaoke data.

12. The method according to claim 11, further comprising the step of controlling the effect sound according to the karaoke data so as to create a sound field matching the displayed background scene.

13. A method of providing audio and video to support a karaoke play based on karaoke data said method comprising the steps of:

generating a musical sound according to the karaoke data as a part of the audio so as to accompany the karaoke play:

displaying a background scene as a part of the video according to the karaoke data in matching with the musical sound; and generating an effect sound as another part of the audio according to the karaoke data so as to produce an acoustic impression specific to the displayed background scene, wherein the step of displaying comprises sequentially displaying different background scenes during the course of the karaoke play, and the step of generating an effect sound comprises sequentially generating different effect sounds corresponding to the displayed different background scenes.

14. A machine readable medium encoded with a program for providing audio and video to support a karaoke play based on karaoke data, said program containing instructions for performing the steps of:

generating a musical sound as a part of the audio so as to accompany the karaoke play, the musical sound being generated based on the karaoke data;

displaying a background scene as a part of the video, the displayed background scene matching with the musical sound and being displayed based on the karaoke data; and generating an effect sound as another part of the audio, the effect sound being associated with the displayed background scene in order to produce an acoustic impression specific to the displayed background scene and being generated based on the karaoke data.

15. The machine readable medium according to claim 14, wherein the program further contains instructions for performing the step of controlling the effect sound according to the karaoke data so as to create a sound field matching the displayed background scene.

16. A machine readable encoded with a program for providing audio and video to support a karaoke play based on karaoke data, said program containing instructions for performing the steps of;

generating a musical sound according to the karaoke data as a part of the audio so as to accompany the karaoke play:

displaying a background scene as a part of the video according to the karaoke data in matching with the musical sound; and generating an effect sound as another part of the audio according to the karaoke data so as to produce an acoustic impression specific to the displayed background scene, wherein the step of displaying comprises sequentially displaying different background scenes during the course of the karaoke play, and the step of generating an effect sound comprises sequentially generating different effect sounds corresponding to the displayed different background scenes.

17. A karaoke apparatus for providing audio and video to support a karaoke play based on karaoke data, said karaoke apparatus comprising:

a first sound device that operates according to the karaoke data for generating a musical sound as a part of the audio so as to accompany the karaoke play;

a display device that operates according to the karaoke data for displaying a background scene as a part of the video, the displayed background scene matching with the musical sound; and a second sound device that operates according to the karaoke data for generating a sound effect as another part of the audio so as to produce an acoustic impression specific to the displayed background scene, wherein the display device sequentially displays different background scenes during the course of the karaoke play, and the second sound device cooperates with the display device for sequentially generating different sound effects corresponding to the displayed different background scenes.

* * * * *